US009302160B2

(12) United States Patent
Song

(10) Patent No.: US 9,302,160 B2
(45) Date of Patent: Apr. 5, 2016

(54) ADJUSTABLE WEIGHT FOR GOLF CLUB HEAD

(71) Applicant: Acushnet Company, Fairhaven, MA (US)

(72) Inventor: Yu Jin Song, San Marcos, CA (US)

(73) Assignee: Acushnet Company, Fairhaven, MA (US)

( * ) Notice: Subject to any disclaimer, the term of this patent is extended or adjusted under 35 U.S.C. 154(b) by 85 days.

(21) Appl. No.: 14/038,393

(22) Filed: Sep. 26, 2013

(65) Prior Publication Data

US 2015/0087439 A1 Mar. 26, 2015

(51) Int. Cl.
*A63B 53/04* (2015.01)

(52) U.S. Cl.
CPC ..... *A63B 53/04* (2013.01); *A63B 2053/0491* (2013.01)

(58) Field of Classification Search
USPC ..... 473/334–339
See application file for complete search history.

(56) References Cited

U.S. PATENT DOCUMENTS

| | | | | | |
|---|---|---|---|---|---|
| 80,435 | A | | 7/1868 | Way | |
| 996,937 | A | | 7/1911 | Mulock | |
| 1,133,129 | A | * | 3/1915 | Govan | 473/337 |
| 1,167,106 | A | | 1/1916 | Palmer | |
| 1,840,924 | A | * | 1/1932 | Tucker | 473/337 |
| 2,545,045 | A | | 3/1951 | Rosan | |
| 2,750,194 | A | * | 6/1956 | Clark | 473/337 |
| 3,212,783 | A | | 10/1965 | Bradley et al. | |
| 3,259,404 | A | | 7/1966 | Papenguth | |
| 3,466,047 | A | | 9/1969 | Rodia et al. | |
| 3,604,755 | A | | 9/1971 | Krekeler | |
| 3,606,327 | A | * | 9/1971 | Gorman | 473/297 |
| 3,652,094 | A | | 3/1972 | Glover | |
| 3,692,306 | A | | 9/1972 | Glover | |
| 4,026,183 | A | | 5/1977 | Bart | |
| 4,043,563 | A | * | 8/1977 | Churchward | 473/338 |
| 4,052,075 | A | * | 10/1977 | Daly | 473/338 |
| 4,085,934 | A | * | 4/1978 | Churchward | 473/338 |
| 4,194,547 | A | | 3/1980 | Sidor et al. | |
| 4,443,145 | A | | 4/1984 | Peschges | |
| 4,450,904 | A | | 5/1984 | Volz | |
| 4,538,790 | A | | 9/1985 | Williams et al. | |
| 4,958,970 | A | | 9/1990 | Rose et al. | |
| 5,154,424 | A | | 10/1992 | Lo | |
| 5,168,767 | A | | 12/1992 | Morita | |
| 5,236,164 | A | | 8/1993 | Iorizzo | |
| 5,320,005 | A | | 6/1994 | Hsiao | |
| 5,547,326 | A | | 8/1996 | Overhues | |
| 5,571,053 | A | * | 11/1996 | Lane | 473/336 |

(Continued)

FOREIGN PATENT DOCUMENTS

| | | | |
|---|---|---|---|
| GB | 2133295 | A | 7/1984 |
| JP | 10137374 | A | 5/1998 |

(Continued)

*Primary Examiner* — William Pierce
(74) *Attorney, Agent, or Firm* — Michael J. Mancuso

(57) ABSTRACT

A removable weight in the form of a plug screw that is received in a receptacle of a golf club head. The weight includes adjustment weight pieces that are added to or subtracted from the screw body to yield the desired weight adjustment. The plug screw is removably connected to the golf club head and includes multiple recesses which receive various shaped weight pieces. The weight pieces can be formed from a variety of materials, each having a particular density to provide a multitude of weight choices.

13 Claims, 1 Drawing Sheet

(56) References Cited

U.S. PATENT DOCUMENTS

| | | | | |
|---|---|---|---|---|
| 5,632,694 | A * | 5/1997 | Lee | 473/336 |
| 5,860,779 | A | 1/1999 | Toosky et al. | |
| 5,904,460 | A | 5/1999 | Kawabata | |
| 6,017,177 | A | 1/2000 | Lanham | |
| 6,089,994 | A * | 7/2000 | Sun | 473/338 |
| 6,159,115 | A * | 12/2000 | Hsu | 473/549 |
| 6,296,574 | B1 | 10/2001 | Kaldis | |
| 6,306,048 | B1 | 10/2001 | McCabe et al. | |
| 6,348,014 | B1 | 2/2002 | Chiu | |
| 6,379,265 | B1 | 4/2002 | Hirakawa et al. | |
| 6,436,142 | B1 | 8/2002 | Paes et al. | |
| 6,458,044 | B1 * | 10/2002 | Vincent et al. | 473/334 |
| 6,719,510 | B2 | 4/2004 | Cobzaru | |
| 6,773,360 | B2 * | 8/2004 | Willett et al. | 473/334 |
| 6,811,496 | B2 * | 11/2004 | Wahl et al. | 473/334 |
| 7,121,956 | B2 | 10/2006 | Lo | |
| 7,166,040 | B2 | 1/2007 | Hoffman et al. | |
| 7,179,034 | B2 | 2/2007 | Ladouceur | |
| 7,186,190 | B1 | 3/2007 | Beach et al. | |
| 7,223,180 | B2 | 5/2007 | Willett et al. | |
| 7,294,065 | B2 | 11/2007 | Liang et al. | |
| 7,351,161 | B2 | 4/2008 | Beach | |
| 7,407,447 | B2 | 8/2008 | Beach et al. | |
| 7,410,425 | B2 | 8/2008 | Willett et al. | |
| 7,410,426 | B2 | 8/2008 | Willett et al. | |
| 7,419,441 | B2 | 9/2008 | Hoffman et al. | |
| 7,452,285 | B2 | 11/2008 | Chao et al. | |
| 7,530,904 | B2 | 5/2009 | Beach et al. | |
| 7,540,811 | B2 | 6/2009 | Beach et al. | |
| 7,566,276 | B2 * | 7/2009 | Billings | 473/251 |
| 7,568,985 | B2 | 8/2009 | Beach et al. | |
| 7,578,753 | B2 | 8/2009 | Beach et al. | |
| 7,628,711 | B2 | 12/2009 | Akinori et al. | |
| 7,632,194 | B2 | 12/2009 | Beach et al. | |
| 7,670,235 | B2 | 3/2010 | Lo | |
| 7,713,142 | B2 | 5/2010 | Hoffman et al. | |
| 7,717,804 | B2 | 5/2010 | Beach et al. | |
| 7,717,805 | B2 | 5/2010 | Beach et al. | |
| 7,771,291 | B1 * | 8/2010 | Willett et al. | 473/337 |
| 7,775,905 | B2 | 8/2010 | Beach et al. | |
| 7,824,277 | B2 * | 11/2010 | Bennett et al. | 473/328 |
| 8,192,302 | B2 | 6/2012 | Knutson et al. | |
| 8,414,422 | B2 * | 4/2013 | Peralta et al. | 473/334 |
| 2002/0042307 | A1 * | 4/2002 | Deshmukh | 473/335 |
| 2002/0137576 | A1 * | 9/2002 | Dammen | 473/336 |
| 2006/0100029 | A1 | 5/2006 | Lo | |
| 2006/0122004 | A1 | 6/2006 | Chen | |
| 2008/0132353 | A1 | 6/2008 | Hsiao | |
| 2008/0276675 | A1 * | 11/2008 | Herdman | 70/493 |
| 2010/0160062 | A1 * | 6/2010 | Teramoto | 473/251 |
| 2011/0152001 | A1 * | 6/2011 | Hirano | 473/337 |
| 2011/0294597 | A1 * | 12/2011 | Teramoto | 473/335 |
| 2013/0303304 | A1 * | 11/2013 | Sato | 473/338 |

FOREIGN PATENT DOCUMENTS

| | | | |
|---|---|---|---|
| JP | 10234902 | A | 9/1998 |
| JP | 10248964 | A | 9/1998 |
| JP | 11319167 | A | 11/1999 |
| JP | 2000005350 | A | 1/2000 |
| JP | 2000176059 | A | 6/2000 |
| JP | 2001149514 | A | 6/2001 |
| JP | 2005160947 | A | 6/2005 |
| JP | 2006081862 | A | 3/2006 |
| JP | 2006122334 | A | 5/2006 |
| JP | 2006187489 | A | 7/2006 |
| JP | 2007313304 | A | 12/2007 |

* cited by examiner

ADJUSTABLE WEIGHT FOR GOLF CLUB HEAD

FIELD OF THE INVENTION

The present invention relates to a removable weight for adjusting the weight of a golf club head. More specifically, the weight comprises multiple weight pieces that may be added or subtracted to adjust the club head weight.

BACKGROUND

Removable weights have been incorporated into golf club heads to distribute discretionary mass in order to alter the performance characteristics of the golf clubs. For example, weights may be incorporated to provide adjustability in characteristics such as swing weight, location of the center of gravity and manipulation of the moment of inertia of a particular golf club head. Various weight designs have been utilized that allow the manufacturer and/or consumer to alter the mass properties of a golf club head.

One example of a weight incorporated into a club head is described in U.S. Pat. No. 1,167,106 to Palmer for a Golf Club. Palmer describes a golf club that includes a threaded opening that receives threaded weight plugs for varying the weight of a cast metal golf club head. The threaded opening extends through a rear wall of the golf club head and receives a threaded plug which may be just long enough to fill the opening or it may extend further into the golf club head to increase the weight. The threaded opening is tapered so that the plug may be tightened to a desired depth. A disadvantage of the threaded weight plug is that it is constructed as a single piece. As a result, torque applied to the weight plug during use of the golf club is transmitted to the threaded portion and may result in the weight plug becoming disengaged, especially with repeated use.

Another example of a removable weight is described in U.S. Pat. No. 6,773,360 to Willett et al. for a Golf Club Having a Removable Weight. The removable weight includes a mass element and a fastener that extends through an aperture in the mass element. A golf club head body includes an interior cavity and a recess on a wall of the body. Inside the recess, a threaded opening is provided so that the fastener may extend through the mass element disposed in the recess and into the threaded opening to fasten the mass element in the recess. Because the fastener extends through the mass element and into a threaded opening in the recess, the size of the mass element and the structure of the recess are limited. Additionally, the mass element is visible to the user when installed so less variation is available for the mass element without detrimentally affecting the aesthetics of the club head.

It is desirable to provide a golf club head and a weight member that allows additional design freedom for the weight while creating fewer restrictions on the golf club head design.

SUMMARY OF THE INVENTION

The present invention relates to a removable weight plug for a golf club head, wherein the plug comprises a body consisting of a threaded portion, a sidewall portion having at least one weight receiving port, and a top portion. At least one pie shaped weight piece of a size and dimension for insertion into one of the receiving ports in the sidewall is included. The weight pieces can be varied in density to provide a golfer the ability to effectively increase or decrease the weight of the club head, without the need for additional pieces. The weights and subsequently the plug can be secure into a receptacle in the golf club head by inserting a rotation tool into the aperture and tightening the plug.

An alternate embodiment isolates the screw portion from the body with an elongated rod as the sidewall, wherein disc shaped weight plates may be attached to or removed from the rod. The discs may vary in number or density to effectively offer the golfer the ability to change the weight of the club head weight, by merely screwing the plug into the golf club head. Subsequently, the screwing action also secures the discs in the screw plug.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE PREFERRED EMBODIMENT

The present invention is directed to a removable weight plug used in conjunction with a golf club head. The removable weight plug 10 alters the mass properties of the golf club head. Several embodiments of the present invention are described below.

Figure 1:
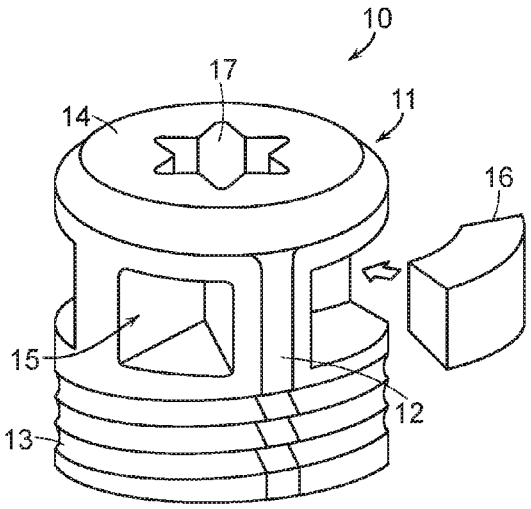
FIG. 1 is perspective and symmetrical view of an adjustable weight for use in a golf club head of the present invention.

Referring to FIG. 1, a removable weight plug 10, including an embodiment of a weight in accordance with the present invention, will be described. Weight plug 10 includes a body that combines a fastener and a weight housing in a single member. The weight plug 10 generally includes as parts of its body 11: a sidewall portion 12; a threaded portion 13; and a top portion 14. The sidewall portion 12 includes a plurality of recessed weight receiving ports 15. Although the number of ports 15 may be varied, the preferred number of ports 15 is four. The recess of each port 15 is in the shape of a pie wedge, which accommodates a pie shaped weight piece 16. The weight piece 16 is sized and dimensioned to be friction-fitted into one of the ports 15 and when properly seated may be secured by the user rotating the plug into a receptacle located in the golf club head (not shown). The receptacle will generally be located on the sole of the club head or about the rear perimeter, with a preference for use with "metal" woods, both drivers and fairway. The top portion 14 of the plug has an aperture 17 defined therein for which a tool may be inserted by the user to rotate the plug until a tight fit is achieved. This not only locks the plug into the club head, but also secures the weight pieces 16 within the body of the plug 10. The overall weight of the club head may be changed merely by replacing weight pieces with pieces having different densities. Tungsten, steel, or any other suitable metal may be employed.

Figure 2:
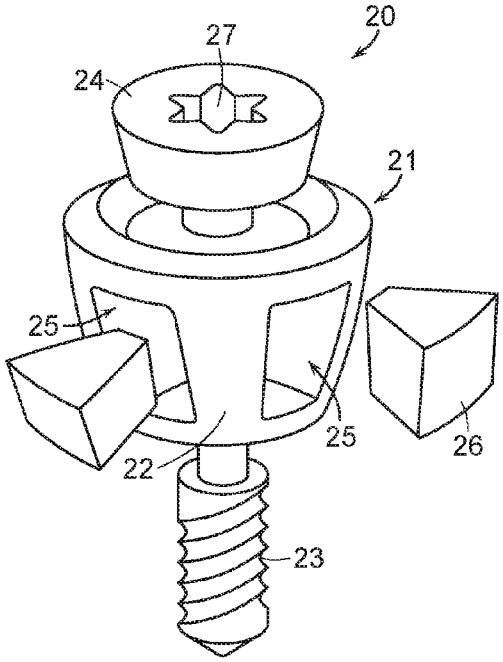
FIG. 2 is a perspective and symmetrical view of an alternate embodiment adjustable weight of the present invention.

In another embodiment, illustrated in FIG. 2, a weight plug 20 includes a fastener and a separate weight housing that. A slightly elongated weight plug 20 is shown wherein the body 21 still contains a top portion 24, a tapered sidewall portion 22, a threaded portion 23, and multiple recessed sidewall ports 25 for accepting the pie shaped weight pieces 26. While the inventive concept remains the same as discussed above, the threaded portion 23 of this embodiment is extended away from the main body of the plug and appears as a more elongated version. The plug is still screwed into the golf club head by a tool that rotates within an aperture 27 at the top of the plug 20. All the prior inventive concepts, i.e., multiple density weight pieces, etc. remain in this embodiment.

Figure 3:
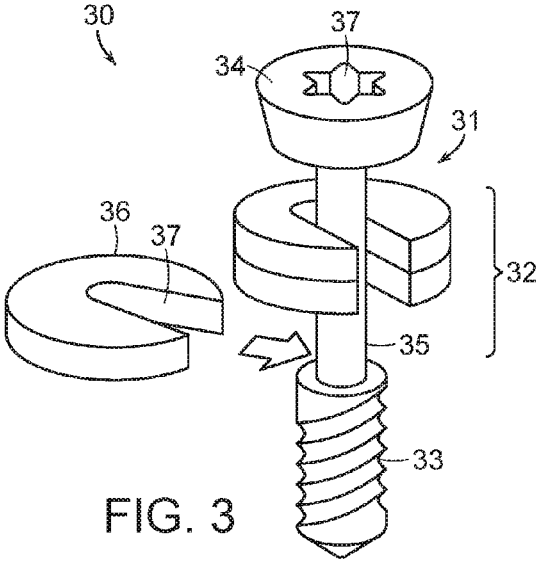
FIG. 3 is a perspective and symmetrical view of still another embodiment adjustable weight of the present invention.

Yet still, another embodiment is shown in FIG. 3, wherein the same inventive concepts are present, but the body 31 of the plug 30 utilizes a slightly different arrangement for a sidewall portion 32. In weight plug 30, a fastener member is coupled directly to weight pieces without a weight housing. In the sidewall portion of this weight plug 30, the weight receiving ports of previous embodiments have been replaced by an elongated rod 35 extending between a top portion 34 and a threaded portion 33, and disc shaped weight plates 36 have replaced the pie shaped weight pieces of the prior embodiments. In particular, each of the disc shaped weight plates 36 includes a slot 37 that receives the elongated rod 35. The slot 37 extends from an edge toward the center of the disc shaped weight plate 36. As shown, a plurality of disc shaped weight plates 36 may be stacked on the elongated rod 35. As the threaded portion 33 is threaded into a portion of a golf club, the disc shaped weight plates 36 are compressed to hold them in place. The disc shaped weight plates 36 may vary in number or density to achieve the targeted weight.

Although the inventive weight is illustrated in a wood-type golf club, it should be appreciated that the weight may be incorporated in any type of golf club. For example, the inventive weight may be included in drivers, fairway woods, utility clubs, hybrids, iron-type golf clubs, wedges and putters.

While it is apparent that the illustrative embodiments of the invention disclosed herein fulfill the objectives stated above, it is appreciated that numerous modifications and other embodiments may be devised by those skilled in the art. Elements from one embodiment can be incorporated into other embodiments. Therefore, it will be understood that the appended claims are intended to cover all such modifications and embodiments, which would come within the spirit and scope of the present invention.

I claim:

1. An adjustable weight plug for removable attachment to a golf club head, the plug comprising:

a body consisting of a threaded portion, a sidewall portion having a plurality of weight receiving ports distributed about a circumference of the side wall, and a top portion;

a weight piece of a size and dimension for insertion into one of the receiving ports in the sidewall, wherein the weight piece is shaped so that it has a thickness and a cross-sectional shape of a sector of a circle; and the top portion having an aperture, wherein the plug is secured in a receptacle in the golf club head by inserting a rotation tool into the aperture and tightening the plug.

2. The adjustable weight plug according to claim 1, wherein the weight piece is removable.

3. The adjustable weight plug according to claim 1, wherein the weight piece includes a plurality of weight pieces having the same shape, wherein at least two of the plurality of weight pieces are formed from different materials having different densities, permitting the overall weight of the plug and subsequently the golf club head to be increased or reduced.

4. The adjustable weight plug according to claim 1, wherein there are a plurality of weight receiving ports, each port having a recess shaped as a sector of a circle for accepting the weight piece.

5. The adjustable weight plug according to claim 4, further comprising a plurality of weight pieces, each shaped as a sector of a circle, disposed in the plurality of weight receiving ports.

6. The adjustable weight plug according to claim 1, wherein the body of the plug is extended in a longitudinal direction to isolate the threaded portion from the weight receiving ports.

7. The adjustable weight plug according to claim 1, wherein the sidewall portion is tapered so that it forms a conical outer surface.

8. The adjustable weight plug according to claim 7, wherein the threaded portion is disposed below the conical outer surface.

9. The adjustable weight plug according to claim 1, wherein the side wall portion has a cylindrical outer surface.

10. The adjustable weight plug according to claim 9, wherein the threaded portion is disposed on the cylindrical outer surface.

11. A removable weight plug for removable attachment to a golf club head, the plug comprising:

a body consisting of a threaded portion, a sidewall portion consisting of a rod, and a top portion;

at least one disc shaped weight plate of a size and dimension for attachment to the rod, wherein the at least one disc shaped weight plate includes a slot extending from an edge of the plate toward a center of the plate, wherein the slot intersects the edge of the plate, wherein the rod is received in the slot; and the top portion having an aperture, wherein the disc is secured to the rod and simultaneously the plug secured to a receptacle in the golf club head by inserting a rotation tool into the aperture and tightening the plug.

12. The removable weight plug according to claim 11, wherein the at least one disc shaped weight plate includes a plurality of disc shaped weight plates, wherein at least two of the plurality of weight plates are formed from different materials having different densities, therein, permitting the overall weight of the plug and subsequently the golf club head to be increased or reduced.

13. The removable weight plug according to claim 11, wherein a plurality of disc shaped weight plates are disposed on the rod.

* * * * *